US009438988B2

(12) United States Patent
Campbell

(10) Patent No.: US 9,438,988 B2
(45) Date of Patent: Sep. 6, 2016

(54) ADAPTABLE BONE CONDUCTING HEADSETS

(71) Applicant: Todd Campbell, Roswell, GA (US)

(72) Inventor: Todd Campbell, Roswell, GA (US)

( * ) Notice: Subject to any disclaimer, the term of this patent is extended or adjusted under 35 U.S.C. 154(b) by 0 days.

(21) Appl. No.: 14/732,292

(22) Filed: Jun. 5, 2015

(65) Prior Publication Data

US 2015/0358720 A1 Dec. 10, 2015

Related U.S. Application Data

(60) Provisional application No. 62/008,466, filed on Jun. 5, 2014.

(51) Int. Cl.
*H04R 25/00* (2006.01)
*H04R 1/10* (2006.01)

(52) U.S. Cl.
CPC ..... *H04R 1/1091* (2013.01); *H04R 2460/13* (2013.01)

(58) Field of Classification Search
CPC ..... H04R 2460/13; H04R 1/1041
USPC ..... 381/151, 74, 309, 326, 328, 370, 374, 381/376
See application file for complete search history.

(56) References Cited

U.S. PATENT DOCUMENTS 8,035,335 B2 * 10/2011 Duron ..... H02J 17/00 320/101
2007/0026369 A1 * 2/2007 Smith ..... A63B 24/0003 434/252
2007/0147630 A1 * 6/2007 Chiloyan ..... H04M 1/6066 381/74
2008/0107289 A1 * 5/2008 Retchin ..... H04R 1/1066 381/151
2008/0107300 A1 * 5/2008 Chen ..... H04R 1/1075 381/380
2008/0166008 A1 * 7/2008 Logan ..... H04M 1/05 381/381
2009/0010461 A1 * 1/2009 Klinghult ..... A61B 5/0002 381/309
2009/0185699 A1 * 7/2009 Kim ..... H04R 1/1066 381/151
2010/0111349 A1 * 5/2010 Devlas ..... H04R 1/1033 381/380
2012/0197635 A1 * 8/2012 Nystrom ..... H04R 1/1016 704/201
2014/0037102 A1 * 2/2014 Alanis ..... H04R 1/1041 381/74

* cited by examiner

*Primary Examiner* — Jesse Elbin
*Assistant Examiner* — Julie X Dang
(74) *Attorney, Agent, or Firm* — Clayton, McKay & Bailey, PC

(57) ABSTRACT

Headsets presented herein may include at least one earpiece having an adjustable bone conduction element and an ear bud. The location of the bone conduction element may be repositioned by sliding a slidably-coupled section to which the bone conduction element is attached. The ear bud may be disengaged without disturbing the positioning of the bone conduction element. Additionally, the earpiece may be attached to a base member via a pivoting element that is coupled to wire that retracts into the base member. The base member can be controlled by a cell phone and charge by plugging into a solar harness.

20 Claims, 14 Drawing Sheets

ADAPTABLE BONE CONDUCTING HEADSETS

CROSS REFERENCE TO RELATED APPLICATION

This non-provisional patent application claims the benefit of priority to provisional application No. 62/008,466 ("Adaptable Bone Conducting Headsets"), filed Jun. 5, 2014, which is hereby incorporated by reference in its entirety.

FIELD OF THE EMBODIMENTS

The embodiments relate generally to adaptable bone conducing smart headsets, and more specifically, to wearable technology that includes ear bud speakers and adjustable bone conduction zones capable of adapting based on user bio physiology.

BACKGROUND

Athletes of all levels, from weekend warriors to professionals, often incorporate headsets for listening to music into their workouts, runs, and even swims. These users wish to listen to music or other media while they exercise.

However, traditional methods and offerings are lacking. One common type of headset simply incorporates two ear buds and a wire that connects to a device, such as a phone. This wire may dangle and become annoying or even obstructive during exercise. Additionally, if an ear bud is disengaged, it traditionally must be held by the user or it will fall from position and become a potential hazard, damage risk, or at the very least an inconvenience to put back in during exercise.

Similar shortcomings exist in current earpieces that wrap around a user's ear or other types of headphones. Disengaging the speaker from the user's ear typically requires substantially removing or repositioning the entire headset apparatus. This can occupy the user's hand or otherwise be an inconvenience in the midst of sporting activities.

Additionally, current headsets generally lack multiple measures of adjustment. In particular, headsets that incorporate bone conduction do not currently include convenient means of adjustment to ensure that the conduction is optimized on the user's skull.

Moreover, current headsets are very limited in their functionality, as they typically do little more than transmit audio and do not otherwise help a user in his or her athletic endeavors.

Therefore, a need exists for headsets that better adapt to a user and assist in athletic endeavors.

SUMMARY

Embodiments described herein include adaptable bone conducing smart headsets that assist a user in athletic endeavors. In one embodiment, the headset includes a left earpiece and right earpiece coupled to a base member designed for resting on the back base of a user's neck. The left and right earpieces may be coupled to the base member via left and right wires. The base member may include a reel member that retracts excess wire slack into the base member simultaneously from the left and right wires.

In one embodiment, the left and right wires each include a pivot element that allow the user to create first and second angles in the left and right wires, dividing the connecting wires into upper and lower portions. The upper portions may connect to the first and second earpieces, respectively.

In one embodiment, each earpieces include at least first and second slidably-coupled sections containing first and second bone conducting elements, respectively. The slidable sections may allow the user to move the first and second bone conducting elements closer together or further apart, wherein the bone conducting elements thereafter substantially remain in the desired relative locations until further adjustment.

In one embodiment, the second slidable section is connected to an ear bud via an adjustable and releasable coupling element. The releasable coupling may allow the user to disengage the ear bud substantially without affecting the positioning of the bone conducting elements along the user's ear and skull.

In one embodiment, the headset may include a battery that is charged by a combination of solar energy, motional energy conversion, and/or heat energy conversion. The processor may cause the battery to conserve energy by changing the power output to one or more speakers after detecting that an ear bud is not engaged.

In another embodiment, the headset includes a temperature regulation mesh that may be used to cool the user with cooling bursts.

In another embodiment, the headset may deliver audio alerts to a user regarding heart rate, workout distances or durations, route guidance, and/or lap reminders.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this disclosure, illustrate various embodiments and aspects of the present invention. In the drawings.

DESCRIPTION OF THE EMBODIMENTS

Reference will now be made in detail to the present exemplary embodiments, including examples illustrated in the accompanying drawings. Wherever possible, the same reference numbers will be used throughout the drawings to refer to the same or like parts.

In one embodiment, a wearable headset apparatus may include at least one earpiece. The earpiece may include at least an ear bud and a bone conduction element, such that sound is delivered to the user through both the ear bud and the bone conduction element. The bone conduction element may be adjustable to sit on the bone of the user's skull by sliding sections of the earpiece to position the bone conducting element. The multiple sections may form an arc around the user's ear, and maintain an arc shape when the sections are slid to position the bone conducting element. Further physical adjustments described herein also make the headset less likely than a typical headset to interfere with the user's physical activity.

In one embodiment, the headset apparatus may also include a base member having a processor. The processor may alternatively reside in the user's cell phone, which the headset apparatus connects to via Bluetooth or some other wireless or wired connection.

In addition to delivering audio information to the at least one earpiece, the processor may also make many decisions to best adapt the headset performance to the user's current activities. For example, the processor may detect if an ear bud is disengaged, and in response deliver a fuller spectrum of sound to the bone conduction element while powering down the ear bud. As another example, the processor may strategically use battery power to provide cooling to a user when they need it through a cooling mesh that is attached to the base member. The processor may also make GPS mapping calculations, and update the user regarding the status of their workout.

Figure 1A:
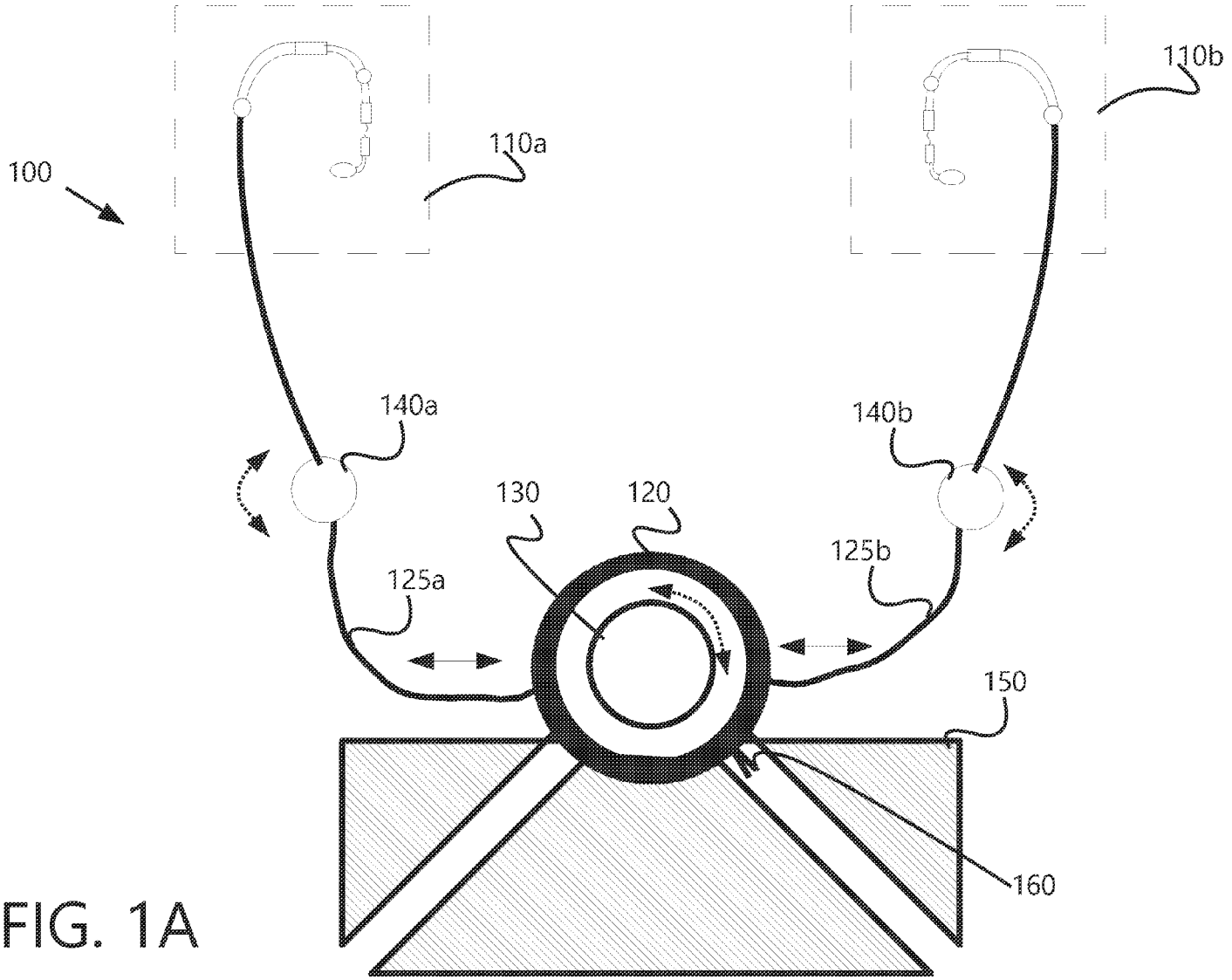
FIG. 1A is an exemplary illustration of a headset, in accordance with an embodiment.

Turning to FIG. 1A, an exemplary headset 100 is illustrated. The headset 100 may include first and second earpieces 110*a* and 110*b* that are communicatively coupled to a base member 120. This coupling may be accomplished with wires 125*a* and 125*b*, as illustrated, or wirelessly in another embodiment (not pictured).

The base member 120 may include a reel 130 that winds wires 125*a* and 125*b* into the base member 120. In one embodiment, the reel is spring-loaded to automatically wind in excess slack from wires 125*a* and 125*b*. In another embodiment, the reel may be manually manipulated by a user, such as by turning the reel, to take in or let out more wire 125*a* and 125*b*. In one embodiment, the user may lock the reel in a certain position, such as by pushing a dial portion in like a button. Pushing it again may deactivate the lock and cause the dial portion of the reel to pop up from the base member 120 for easier manipulation by the user.

Because a single spool may wind both wires 125*a* and 125*b* simultaneously, the lengths of the wires 125*a* and 125*b* outside of the base member 120 may remain substantially the same.

In one embodiment, wires 125*a* and 125*b* may include pivot elements 140*a* and 140*b* respectively. The pivot elements may act as a stop to further reeling in the wires 125*a* and 125*b* into the base member 120 in one embodiment.

In addition, each pivot element 125*a* and 125*b* may allow the user to angle the wires 125*a* and 125*b* such that they are unobtrusive and kept as tight as possible against the user's body. For example, slack may be minimized between a pivot member 140*a* and the base member, causing that portion of wire 125*a* (i.e., lower portion) to run substantially vertically up the back of the user's neck. Pivot element 140*a* may then point the rest of wire 125*a* (i.e., upper portion) towards the user's ear. The upper portion may be more ridged than the lower portion in one embodiment, allowing less slack in the upper portion and keeping a tight fit from the user's neck to the skull area around the user's ear.

Base member 120 can further include an additional knob that acts as a selector or tuner for various audio sources, such as radio (AM/FM/Satellite), Internet-music providers, and music on the phone. The knob can be concentric to the reel 130, with a different diameter and/or vertical level. Working in conjunction with an application that executes on the phone, the user can program the knob to cycle between whichever music services the user prefers. The knob may cause the phone to signal which option has been selected, such as with a quick chime that distinguishes one source from another. The knob can also be slotted such that it clicks into place after rotating to specific points, with each point allowing the base member 120 to communicate a channel identifier to the cell phone. The cell phone may then retrieve the audio source programmatically associated with the channel identifier.

The example headset 100 of FIG. 1A also includes a thermodynamic element 150. The thermodynamic element 150 may be a mesh that hangs in one or more sections from the base member 120. The thermodynamic element may make contact with the user's skin, such as the user's neck and back, and provide cooling via conduction as the user is performing a physical activity.

In one embodiment, the thermodynamic element 150 may be retracted by folding from three sections into a single stacked mesh that may be cranked or stuffed into the base member 120.

In one embodiment, the thermodynamic element 150 is comprised of copper wire enclosed in a water-wicking polyester. The copper wire may conduct the cold temperature and the water wicking polyester may provide a buffer that prevents the cold from burning the user's skin. Instead, the user's own sweat may enter the polyester material and conduct the cold onto the user's skin. Air flow may also provide adequate conduction in one implementation.

In another embodiment, in addition to or in the alternative of the water-wicking polyester, a waterproof silver coated conductive fabric may be used.

In one embodiment, the thermodynamic element 150 slides under the user's shirt, and a solar panel is positioned on top of the user's shirt. The peltiers of the thermodynamic element 150 may be in contact with the user's skin in this arrangement.

In another embodiment, the thermodynamic element 150 may include a mesh material situated between two sheets. When active, this thermodynamic element may form a wind tunnel, propping up the shirt opening at the back of the user's neck, to allow more air to reach the mesh. The wind tunnel effect may increase the efficacy of the thermodynamic element 150 in one embodiment by better facilitating cooling transfer to the user's body.

Figure 1B:
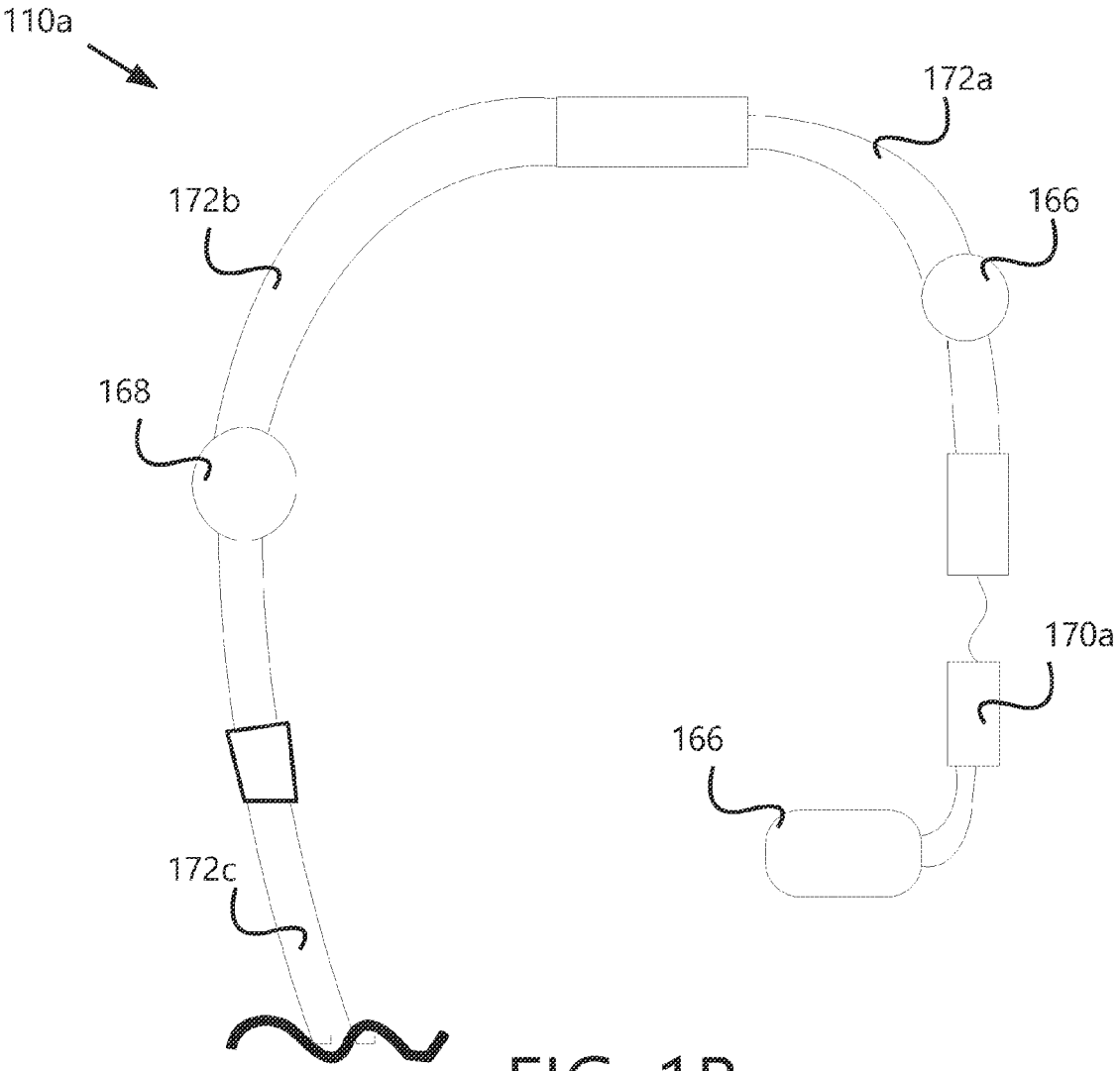
FIG. 1B is an exemplary illustration of an earpiece, in accordance with an embodiment.
Figure 1C:
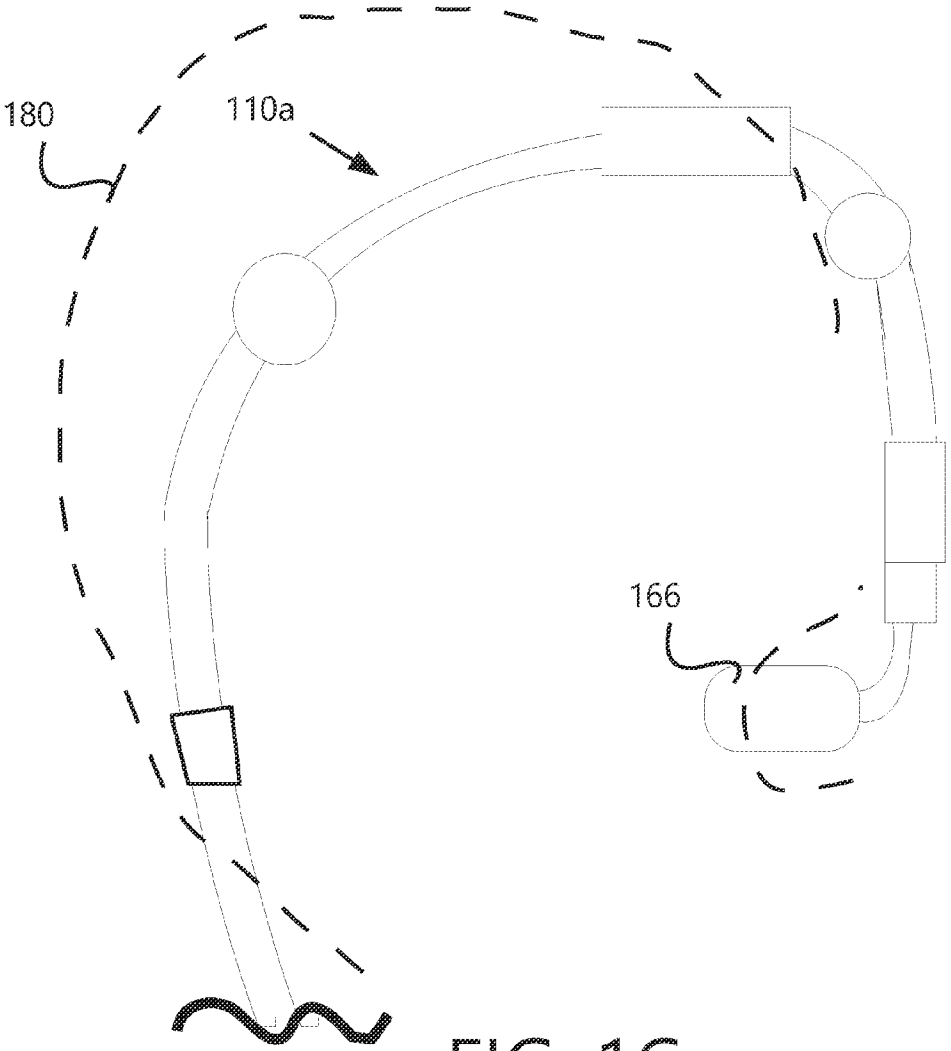
FIG. 1C is an alternate exemplary illustration of an earpiece, in accordance with an embodiment.
Figure 1D:
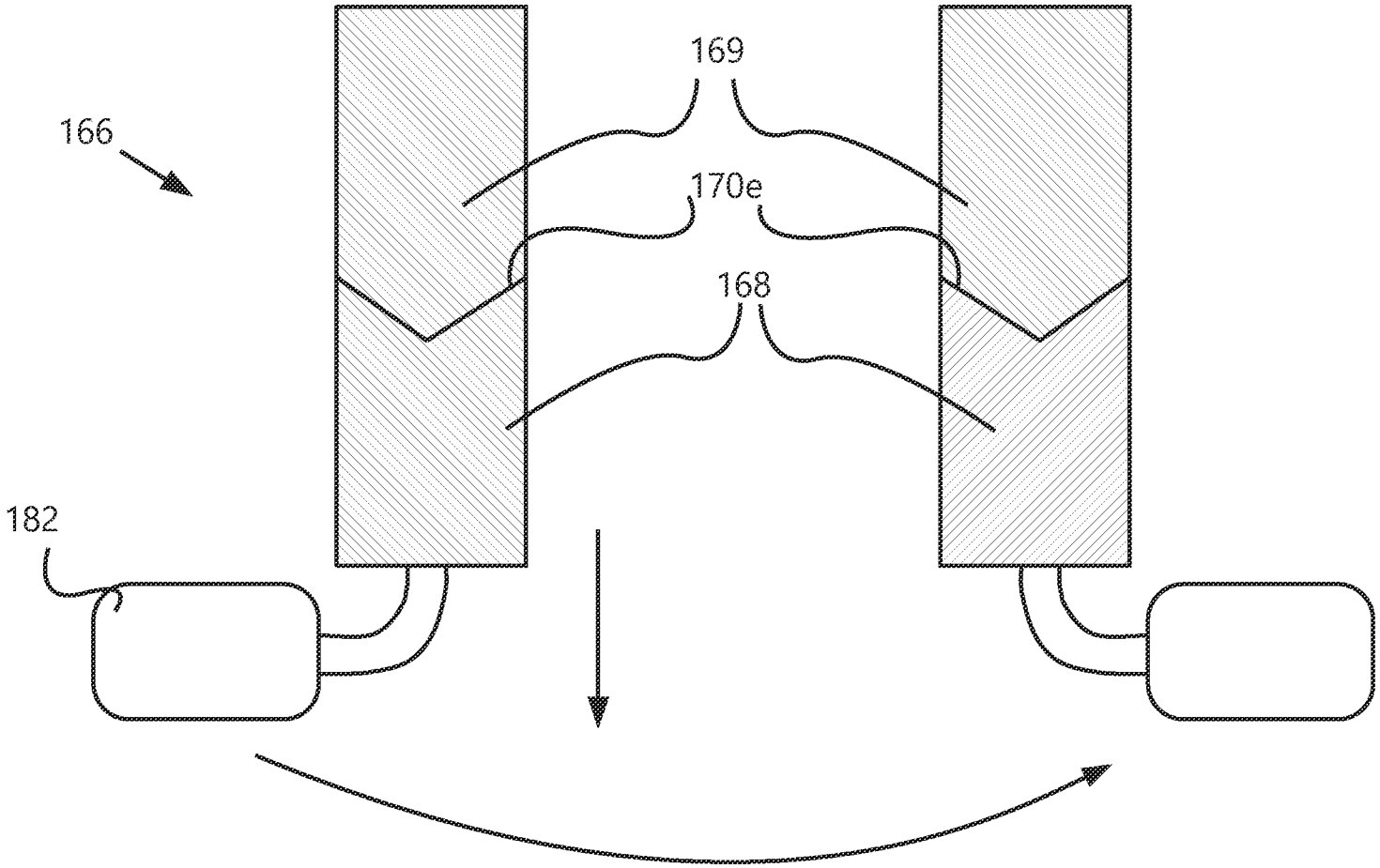
FIG. 1D is an exemplary illustration of an ear bud, in accordance with an embodiment.
Figure 1E:
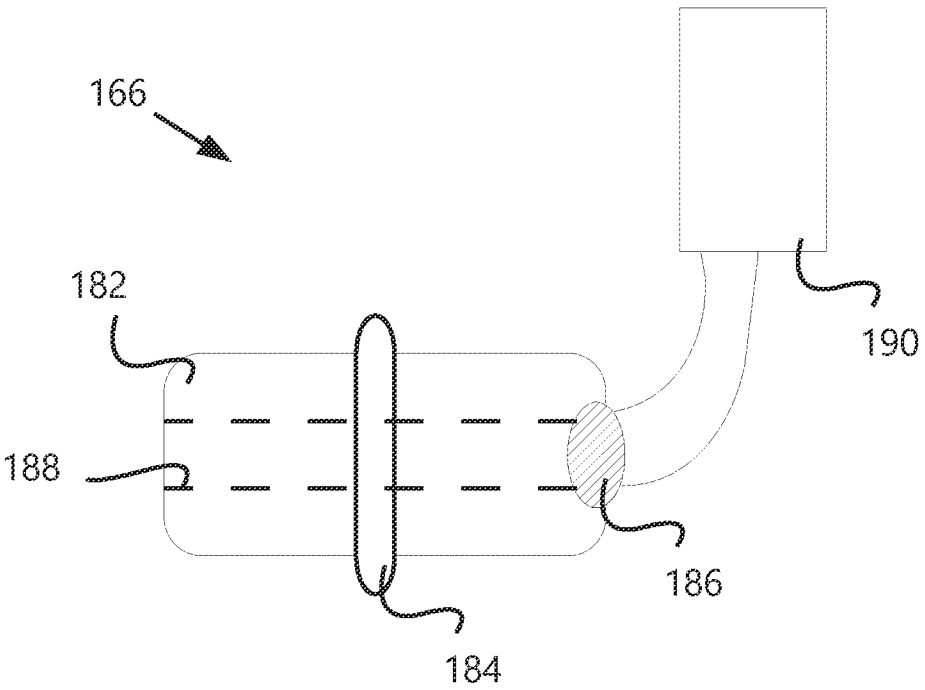
FIG. 1E is an exemplary illustration of an ear bud, in accordance with an embodiment.
Figure 1F:
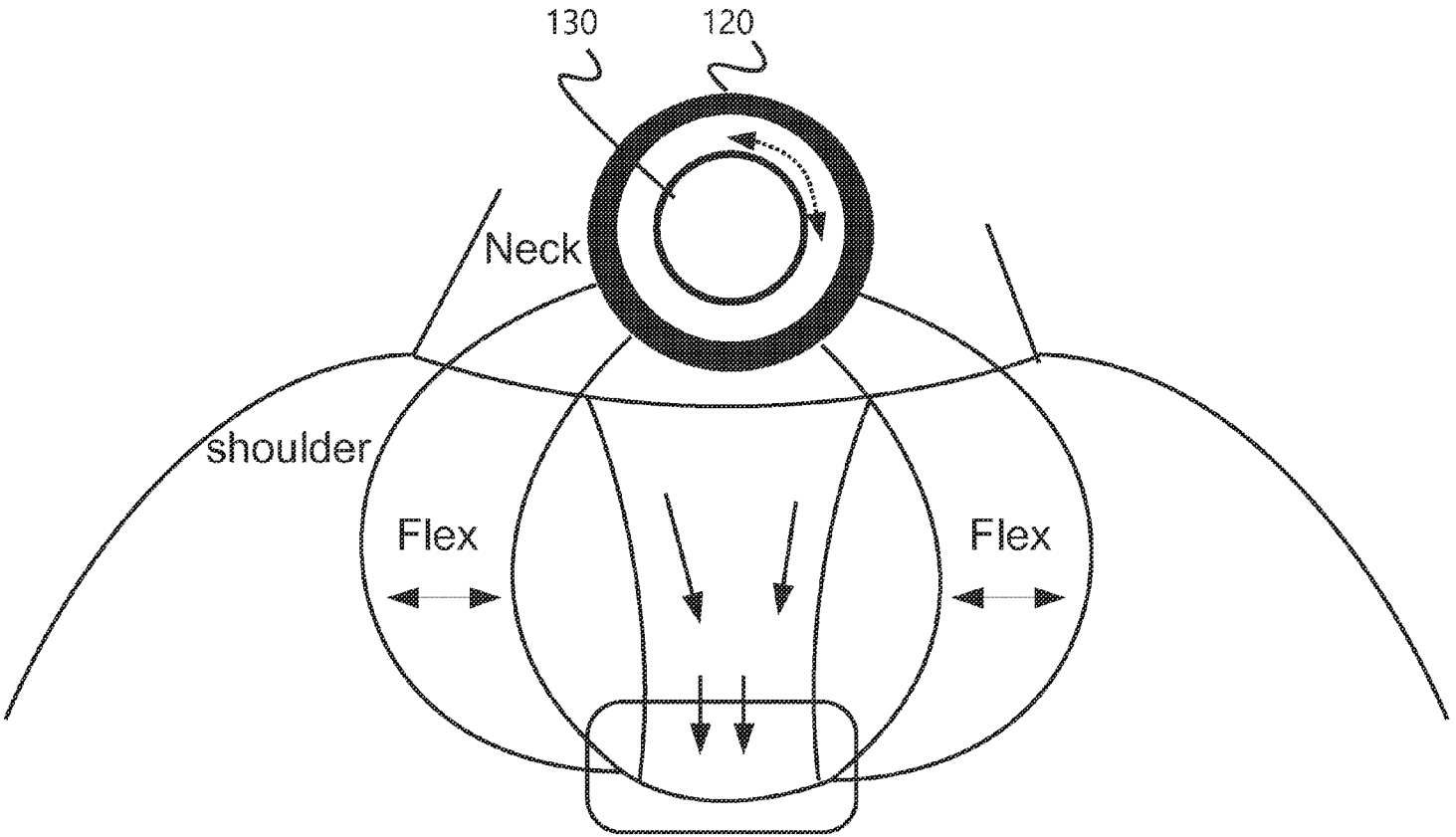
FIG. 1F is an exemplary illustration of a system, in accordance with an embodiment.

An example of the wind tunnel functionality is provided in FIG. 1F. Another drawing is also presented in the Appendix attached to this application. In these examples, the top layer of the thermodynamic element may be pulled inward to separate from the mesh material by raising up and forming a wind tunnel. The top layer may also be hot if it supports a solar panel, which may be absorbing heat. The wind tunnel may cool the top layer, as well as the bottom layer, which receives heat from the user's skin. The top and bottom layers may act as generator and cooling Peltier layers, respectively.

The cooling may be accomplished via a Peltier effect in one embodiment. Each section may be its own Peltier cooling mesh or zone. Each zone may use a combination of the Seeback effect, Peltier effect, and Thompson effect to convert electricity to heat or cool the user, depending on the ambient air temperature. The base member 120 may heat or cool by transferring current from one conductor to another, causing one side of the conductor junction to heat up while the other cools down. If the user needs to be cooled, then the conductor layer against the user's skin is cooled. If the user needs to be heated, then the conductor layer against the user's skin is heated.

In another embodiment, heating or cooling may be accomplished using heat pump technology in conduction with the thermodynamic element 150. For example, the base member 120 may remove heat from the copper mesh of the thermodynamic element 150. Heat may be ejected from the base member 120 in a direction away from the user's body in one embodiment.

In another embodiment, the heat pump process may be reversed. This may occur, for example, if the base member 120 detects that outside temperatures are cold. By reversing the process, the thermodynamic element 150 may actually be heated, causing it to warm the user as the user performs activity outdoors.

Such processes may be powered by a battery within the base member. The battery may be a lithium ion or lithium polymer battery in one embodiment.

The headset 100 may also include one or more ports 160 on the base member for additional functionality. For example, the base member may receive a charge through a port 160. In one embodiment, this allows the base member 120 to connect to wearable solar panels. For example, the solar panels may be woven into the user's clothing in one embodiment.

Figure 7:
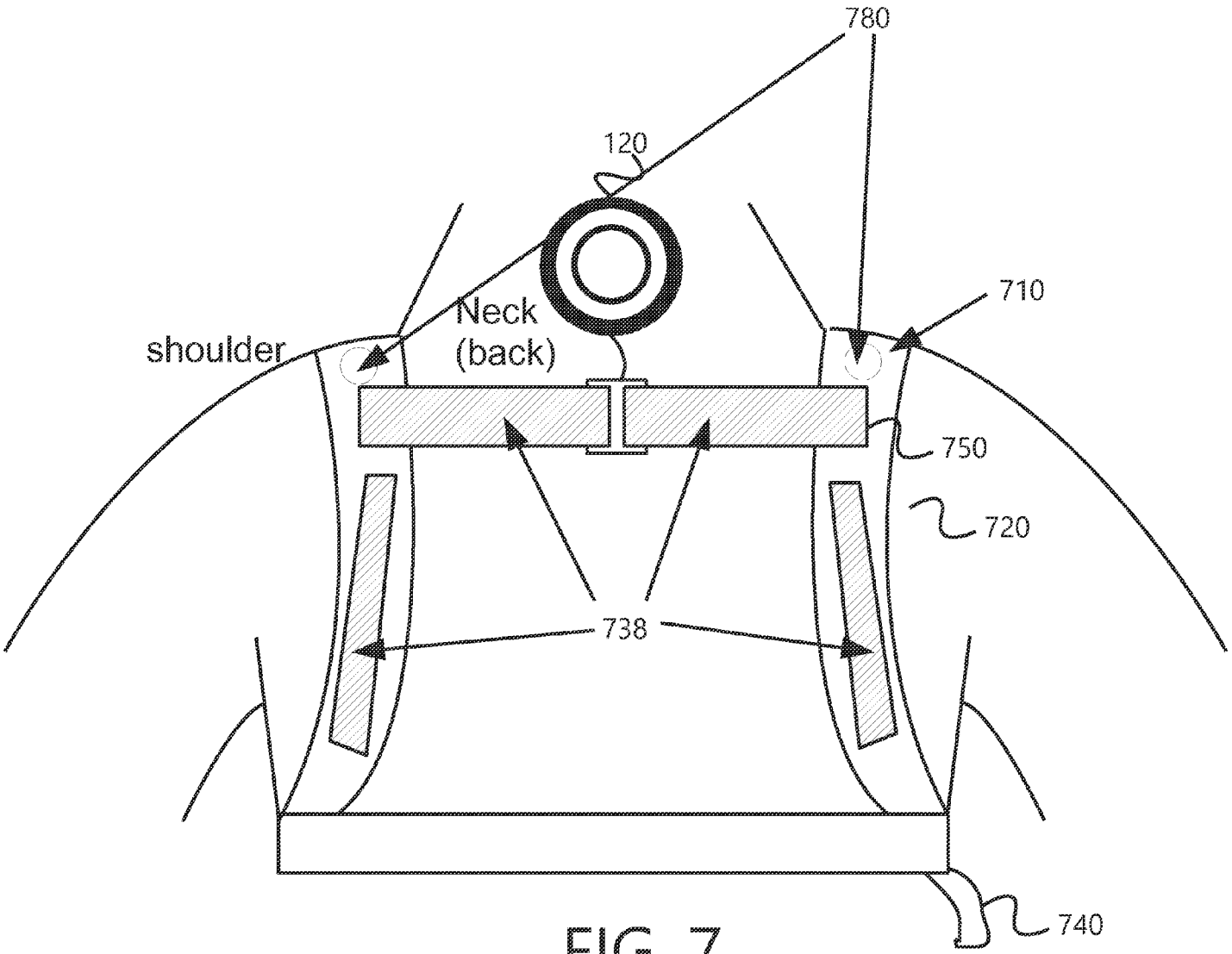
FIG. 7 is an exemplary illustration of a solar harness on the back of a user, in accordance with an embodiment.
Figure 8:
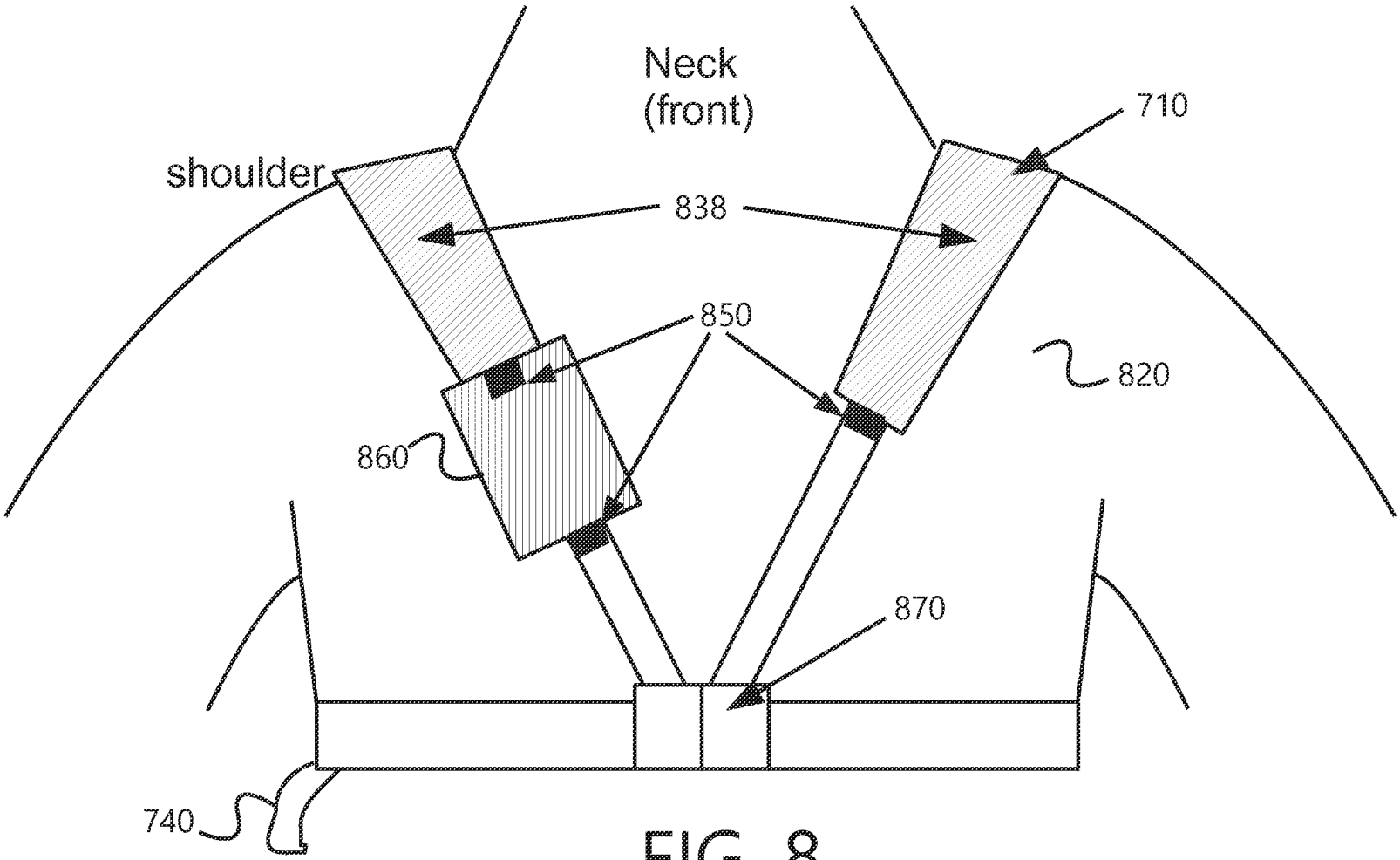
FIG. 8 is an exemplary illustration of a solar harness on the front of a user, in accordance with an embodiment.

In an example more fully discussed with regard to FIGS. 7 and 8, the headset may connect to a solar harness that is worn by the user. The solar harness may include solar panels that the user straps onto their body, allowing for charging of a cell phone, the headset, or other devices that can connect, such as through one or more USB ports.

The user can alternatively strap the solar harness over a backpack in an embodiment. In one embodiment, panels 838 attach to clips 850 near pocket 860 that allow the panels to clip over other straps the user may be wearing, such as backpack straps or suspenders.

In another embodiment, port 160 may be used to charge the battery of the base member 120 through USB or other known methods of charging. The base member can connect to a solar harness in one embodiment. This connection can be magnetic, allowing for easily disengaging the headset, for example, if the connection wire is snagged during athletic activity.

Other charging techniques may be used. For example, the base member may also internally contribute to charging the battery by converting motion into electric charge. This may be done through methods currently used, for example, in wrist watches.

Also, the base member 120 may convert heat to electricity in one embodiment, such as by using a small generator built into the base member 120 or into clothing that plugs into the base member 120. For example, a glass and fabric-based thermoelectric generator can convert the heat of the user's body into electric energy by using the temperature difference between the user's skin and air.

Turning now to FIG. 1B, an exemplary earpiece 110*a* is shown in greater detail. Unlike prior bone conduction earpieces, earpiece 110*a* may allow the user to adjust the location of at least one bone conduction element 166 so that it sits directly on the temporal bone near to the front of the user's ear and/or the mastoid bone behind the user's ear. Because human heads are shaped differently from one another, this adjustment may allow for more effective audio delivery using bone conduction.

Continuing with FIG. 1B, in addition to a first bone conduction element 166, the earpiece 110*a* may also include a second bone conduction element 168. Whereas the first bone conduction element 166 may be placed on the temporal bone towards the top and front of the user's ear, the second bone conduction element 168 may be placed on the user's mastoid bone substantially behind the back bottom portion of the user's ear.

The earpiece 110*a* may also include an ear bud 166. As shown, the ear bud 166 may be detachably coupled at 170 to a first portion 172*a* of the earpiece 110*a*, which may include the first bone conduction element. For example, FIG. 1*b* shows the portions 170*a* and 170*b* in a detached position.

The second bone conduction element 168 may be coupled to a second portion 172*b* of the earpiece 110*a*.

The first and second portions 172*a* and 172*b* may be slidably coupled to one another. By sliding the portions further into or out of one another, the relative spacing of bone conduction elements 166 and 168 may be adjusted. For example, the first section 172*a* may slide into the second section 172*b*, effectively bringing the bone conduction elements 166 and 168 closer together. The conductive wire may be malleable enough to bunch up when the sections 172*a* and 172*b* are slid into one another, and have enough slack to allow the sections to be slid further apart without damaging connections to the bone conduction elements 166 and 168 or ear bud 166.

In one embodiment, a third portion 172*c* is slidably coupled to the second portion 172*b*. This may allow the second portion 172*b* to slide towards or away from the first portion 172*a* substantially without pulling on the upper portion of the wire 125*a* that extends from the base member 120 (or pivot element 140*a*) to the earpiece 110*a*. In one embodiment, a second pivot element forms the coupling between wire 125*a* and the earpiece 110*a*.

FIG. 1*c* is similar to FIG. 1*b* but shows the earpiece 166 coupled in an engaged position with the first portion 172*a*. It also gives an example outline of a user's ear 180 to illustrate how the earpiece 110*a* may fit behind the user's ear. In one embodiment, the earpiece 110*a* may also include a low-tension clip to hold the earpiece 110*a* steady on the user's ear.

In one embodiment, the earpiece 110*a* may substantially maintain its shape while also allowing a user to bend the earpiece 110*a* to form a second shape, which is then maintained. This may be accomplished in one embodiment by utilizing a conductive wire within the earpiece that is rigid enough to maintain its shape after a user has bent it into position. The wire may be a 16 gauge copper wire in one embodiment that may be malleable while also retaining its basic shape. It may provide come customizable bending while also allowing the earpiece 100*a* to substantially hold its shape.

In one embodiment, the base member utilizes a processor (e.g., in the base member or in a cell phone in communication with the base member) to detect whether the ear bud 166 is engaged, as in FIG. 1*c*, or disengaged, as in FIG. 1*b*. If it is disengaged, the processor may not send any voltage to the ear bud, conserving battery power. This is further described with respect to FIG. 4, below.

When the ear bud is disengaged, as in FIG. 1*b*, it may hang by a wire from the first section 172*a*. In one embodiment, the wire that it hangs from is the wire that conducts the sound information. The wire may have elastic or spring properties, allowing a first connector to disengage and/or rotate with respect to a second connector.

An example is provided in FIG. 1D of an embodiment that allows disengagement and rotation of an earpiece 166. As shown, the coupling of the earpiece may include a first connector 168 and a second connector 169 that couple together along a saw-like cut 170*e*. The first connector 168 may be disengaged from the second connector 169 by pulling down and/or rotating, and may lock back along the saw-like cut 170*e* at a different orientation. In this example, the first connector 168 may lock back into place at 180 degree orientation offset as compared to the original position. This may, for example, allow a user to disengage the foam portion 182 from the user's ear and lock it in an orientation that does not face back into the user's ear canal. In another embodiment, the first connector rotates only 90 degrees before locking. For example, the foam portion 182 may be rotated away from the user's ear canal, and snapped back into position in an alignment that faces forward (i.e., in the direction of the user faces).

FIG. 1D illustrates an exemplary ear bud 166 in accordance with an embodiment. The ear bud 166 may include a foam portion 182 for insertion into the ear and conformance with the outer portion of the ear canal. To form a more effective seal in the ear canal, the ear bud 166 may include an O-ring 184 made of foam or rubber that is positioned around the circumference of the foam portion 182. In another embodiment, a second O-ring or a water sealing flare may be added to further prevent water from reaching the opening of the foam portion 182 in the ear canal.

A speaker 186 along with an audio driver (e.g., amplifier or pre-amplifier) may be located at a distal end of the foam piece, sealed from exposure to water. A passage or tube 188 through the foam portion 182 to an open distal end may allow the sound to travel from the speaker 186 to the user's ear canal. In another embodiment, the speaker may be embedded towards the distal end of the form portion 182.

In one embodiment, the O-ring 184 and foam portion 182 may act together to prevent water from entering the ear canal and reaching the open distal end of the foam portion. By preventing water from reaching the open distal end, the speaker 186 may also be better preserved. This may allow a headset including ear bud 166 to be used, for example, while swimming.

In one embodiment, coupling piece 190 includes a sensor to determine if the ear bud 166 is coupled to the first portion 172*a*. If it is not, the ear bud 166 may communicate with the base member 120 to cause the base member to cease sending audio information (e.g., voltage) to the ear bud 166. The sensor in the coupling piece 190 may likewise detect when the coupling has occurred, and cause the base member 120 to again send audio information to the ear bud 166.

In another embodiment, the headset 100 includes a bone conducting microphone for translating pitches generated by the user's humming or singing into MIDI information. For example, the microphone may conductively receive sound vibrations from a portion of the user's skull, and send the sound information to the base member. The processor of the base member may include an analog-to-digital converter in one embodiment. In another embodiment, the processor may detect dynamic frequency information in the sound information, and convert the frequency to MIDI note information. The MIDI information may then be sent to an external module over a connection, such as WIFI, Bluetooth, USB, or MIDI cable. The external module may utilize the MIDI information in a video game, automated workout program, music application or virtual synthesizer, or other application.

In another embodiment, the microphone can include a piezo tuner that mounts against a user's throat. Rather than using bone conduction, the microphone can use vocal conduction through the user's throat. The user can push a button on the headset or cell phone to talk in one embodiment. The button is located near the throat or closer to the ear in embodiments.

Additionally, a user can disengage the headset and fold it into a position that the headset recognizes as indicating use as a speaker. In that case, the headset may drive the speakers with more power, causing the headset to transform into an external speaker. For example, the user can place the folded headset on a table and it will perform as a speaker that amplifies volume levels to at least 4 times the levels utilized in headset mode.

Figure 2:
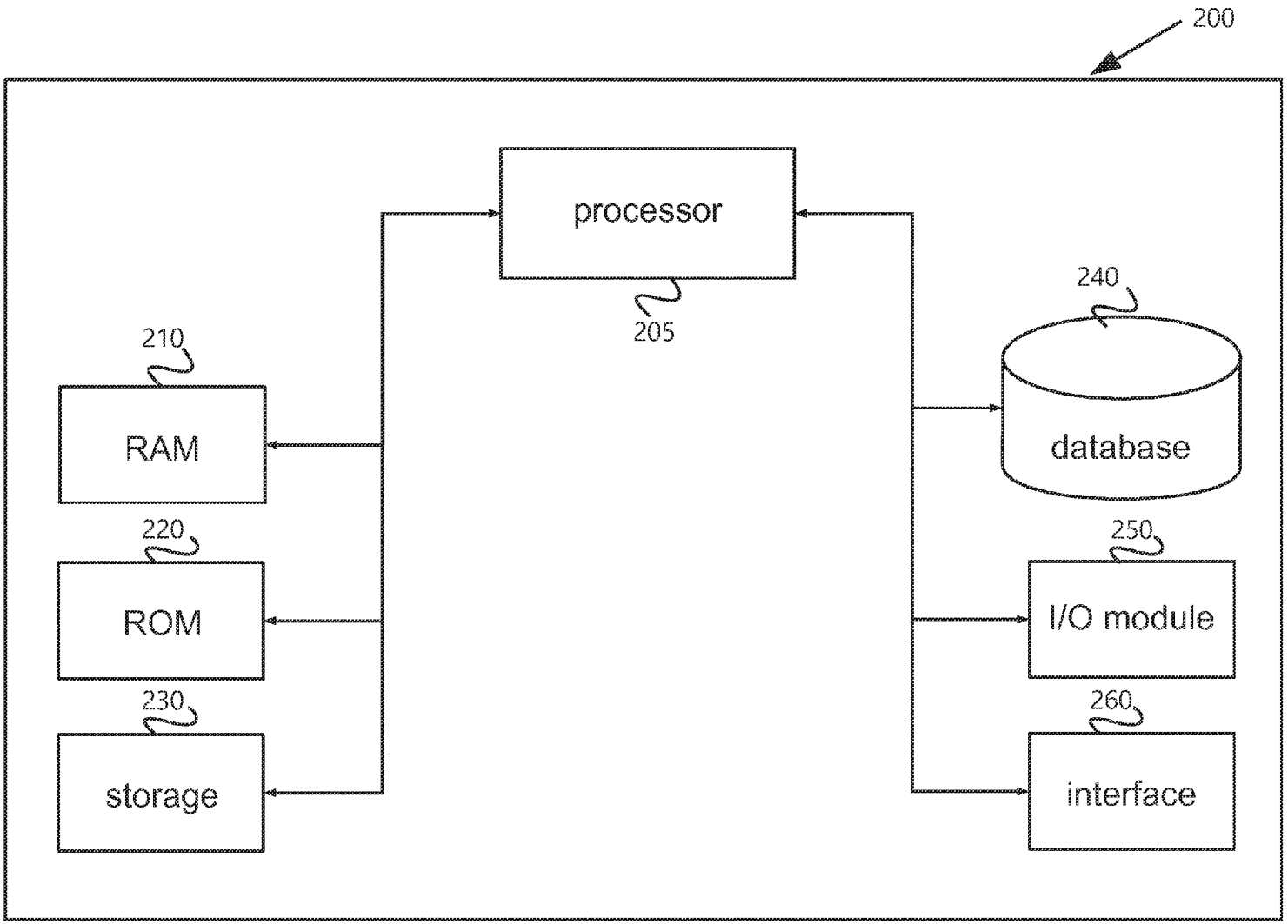
FIG. 2 is an exemplary diagram of a processing system, in accordance with an embodiment.

FIG. 2 depicts an exemplary processor-based processing system 200 representative of the type of processing system that may be present in or used in conjunction within the headset within the base member. The processing system 200 is exemplary only and does not exclude the possibility of another processor- or controller-based system being used in or with one of the aforementioned components. For example, many of the functions described herein can be executed by a processor located in a cell phone that is in communication with the headset.

In one aspect, system 200 may include one or more hardware and/or software components configured to execute software programs, such as software for storing, processing, and analyzing data. For example, system 200 may include one or more hardware components such as, for example, processor 205, a random access memory (RAM) module 3210, a read-only memory (ROM) module 220, a storage system 230, a database 240, one or more input/output (I/O) modules 250, and an interface module 260. Alternatively and/or additionally, system 200 may include one or more software components such as, for example, a computer-readable medium including computer-executable instructions for performing methods consistent with certain disclosed embodiments. It is contemplated that one or more of the hardware components listed above may be implemented using software. For example, storage 230 may include a software partition associated with one or more other hardware components of system 200. System 200 may include additional, fewer, and/or different components than those listed above. It is understood that the components listed above are exemplary only and not intended to be limiting.

Processor 205 may include one or more processors, each configured to execute instructions and process data to perform one or more functions associated with system 200. The term "processor," as generally used herein, refers to any logic processing unit, such as one or more central processing units (CPUs), digital signal processors (DSPs), application specific integrated circuits (ASICs), field programmable gate arrays (FPGAs), and similar devices. As illustrated in FIG. 2A, processor 205 may be communicatively coupled to RAM 210, ROM 220, storage 230, database 240, I/O module 250, and interface module 260. Processor 205 may be configured to execute sequences of computer program instructions to perform various processes, which will be described in detail below. The computer program instructions may be loaded into RAM for execution by processor 205.

RAM 210 and ROM 220 may each include one or more devices for storing information associated with an operation of system 200 and/or processor 205. For example, ROM 220 may include a memory device configured to access and store information associated with system 200, including information for identifying, initializing, and monitoring the operation of one or more components and subsystems of system 200. RAM 210 may include a memory device for storing data associated with one or more operations of processor 205. For example, ROM 220 may load instructions into RAM 210 for execution by processor 205.

Storage 230 may include any type of storage device configured to store information that processor 205 may need to perform processes consistent with the disclosed embodiments. It may also store, for example, digital music files.

Database 240 may include one or more software and/or hardware components that cooperate to store, organize, sort, filter, and/or arrange data used by system 200 and/or processor 205. For example, database 240 may include information that tracks running or swimming routes and/or times. The user may be alerted if they are ahead of pace compared to prior efforts as they are in the middle of their run or swim. Alternatively, database 240 may store additional and/or different information. Database 240 may also contain a plurality of databases that are communicatively coupled to one another and/or processor 205, of may connect to further database over the network.

I/O module 250 may include one or more components configured to communicate information with a user associated with system 200. For example, I/O module 250 may include an LCD or LED screen on base member 120, such as at the center of a surrounding dial, that allows the user to turn and push the dial to make inputs and selections regarding input parameters associated with system 200, such as workout or route information. In one embodiment, the I/O module 250 allows the user to wirelessly input parameters, through use of a phone application or a Bluetooth keyboard connection. I/O module 250 may also include a display including a graphical user interface (GUI) for outputting information on a monitor. I/O module 250 may also allow access to peripheral devices such as, for example, a printer for printing information associated with system 200, a user-accessible disk drive (e.g., a USB port, a floppy, CD-ROM, or DVD-ROM drive, etc.) to allow a user to input data stored on a portable media device, a microphone, a speaker system, or any other suitable type of interface device.

Interface 260 may include one or more components configured to transmit and receive data via a communication network, such as the Internet, a local area network, a workstation peer-to-peer network, a direct link network, a wireless network, or any other suitable communication platform. For example, interface 260 may include one or more modulators, demodulators, multiplexers, demultiplexers, network communication devices, wireless devices, antennas, modems, and any other type of device configured to enable data communication via a communication network.

Figure 3:
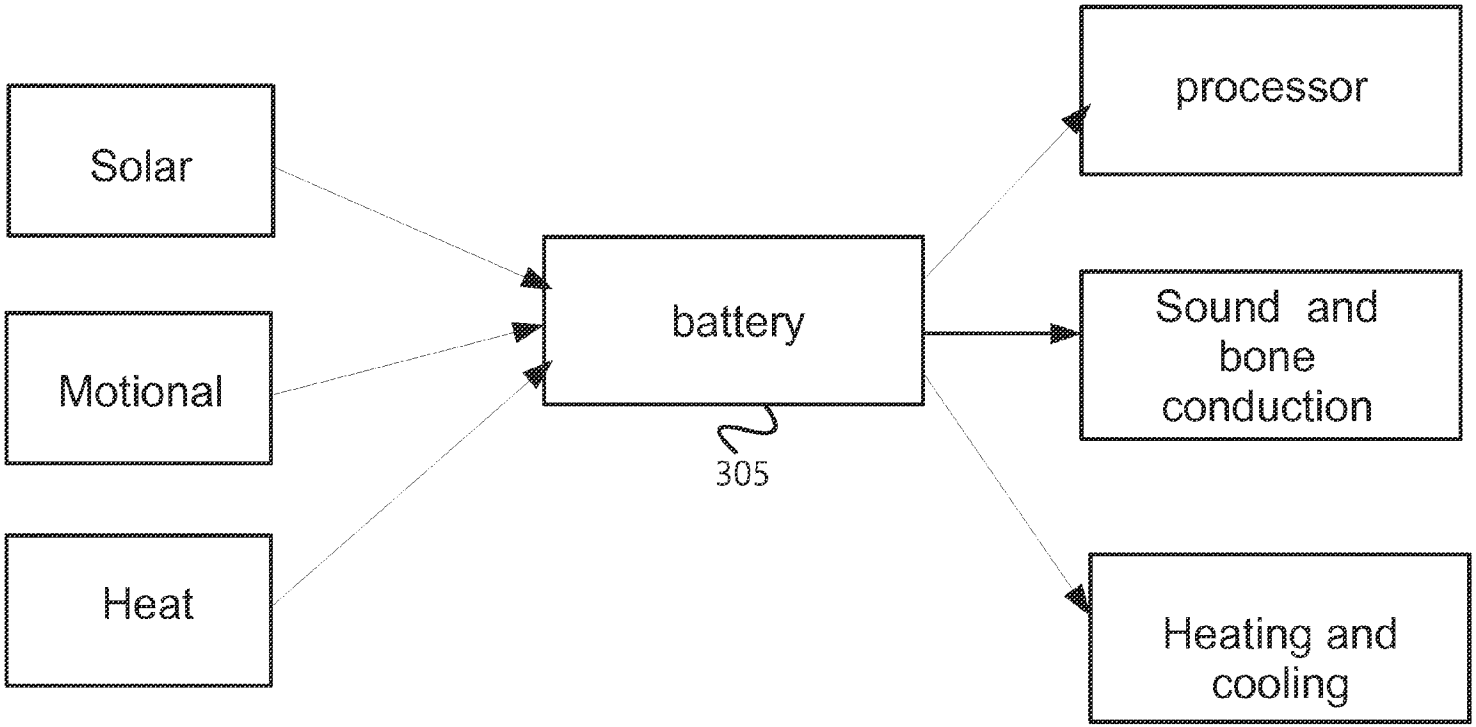
FIG. 3 is an exemplary diagram of an apparatus energy cycle, in accordance with an embodiment.

Turning to FIG. 3, various energy inputs and outputs relative to the battery 305 within the base member 120 are shown. For example, the battery may utilize solar power to recharge. This may be done by attaching solar panels to the base member 120 in one embodiment. In another embodiment, the user may wear solar-ready clothing, which may include an input into the base member 120.

In another embodiment, the base member 120 may include a mechanism for converting motional mechanical energy into electricity. For example, a lever that swings back and forth based on the user's running or swimming motions may contribute small amounts of charge with each motion that overtime may represent a significant amount of charge to the battery 305.

The battery 305 may also charge based on heat in one embodiment. For example, heat transmitted through the thermodynamic element when the thermodynamic element is not activated may power a small generator in the base member 120.

The battery 305 also faces several sources of power drain in one embodiment. For example, the processor requires a known amount of current to function correctly. Other related elements, such as memory, will require further power.

In addition, sound is created by causing vibrations in the bone conduction element and the ear buds, both of which require power.

Finally, any heating and cooling through the thermodynamic element will require power to run a heat pump process. In one embodiment, a heat coil converts electricity directly into heat.

Figure 4:
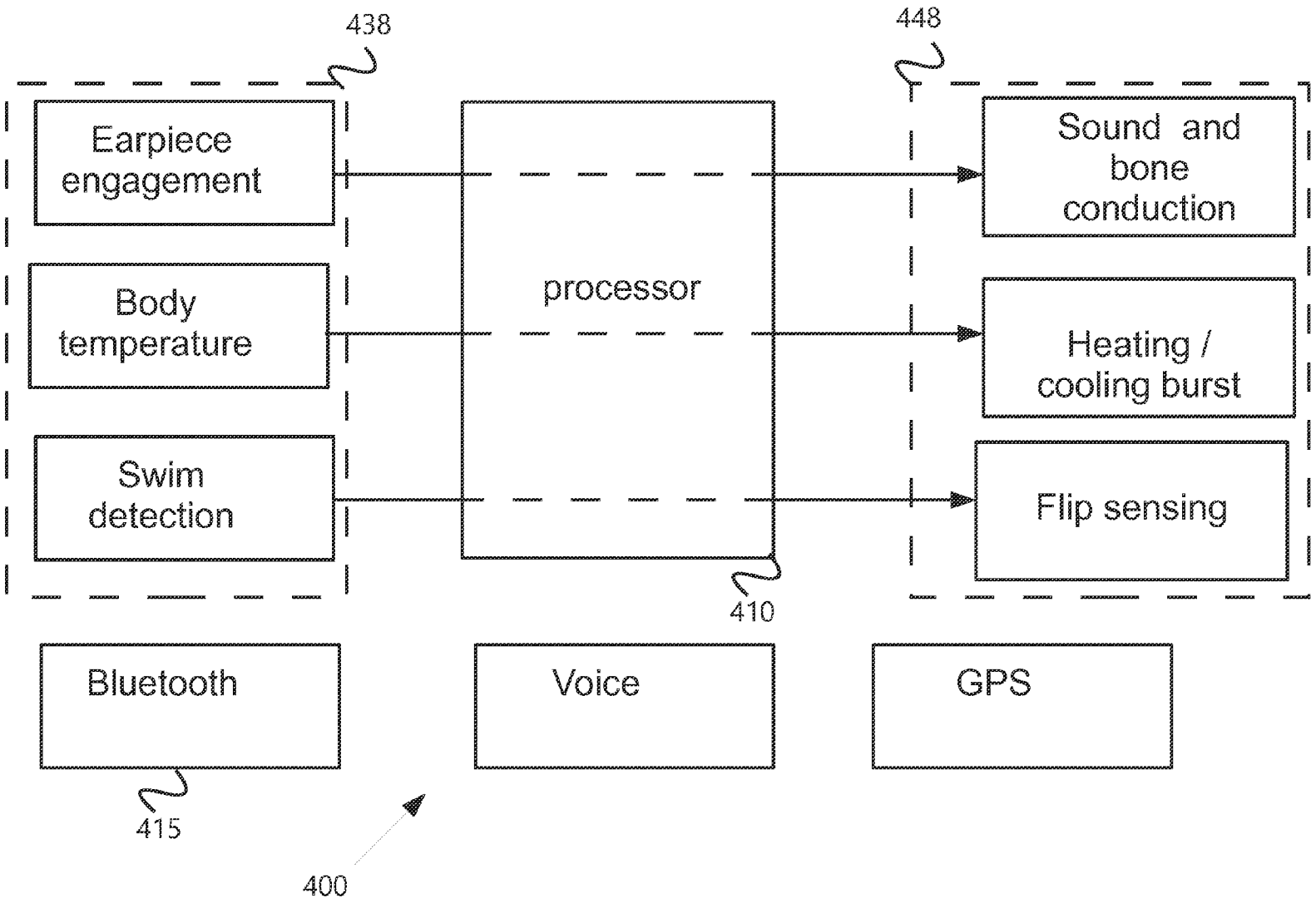
FIG. 4 is an exemplary diagram of apparatus functionality, in accordance with an embodiment.

Turning to FIG. 4, an exemplary diagram of activity functions 400 is provided. As has been discussed, when a sensor may detect whether the earpiece is fully engaged, such as by detecting whether the ear bud is coupled to the first portion of the earpiece. If it is disengaged, the processor may make changes to the sound delivery.

The processor 410 can be part of a cell phone that is in communication with the headset and/or harness. Thus, the harness and/or headset may communicate sensor readings 438 to the cell phone processor 410, such that the cell phone detects earpiece engagement, body temperature, swing direction, and other functions. Based on these detections, the cell phone may perform further functions 448, such as sound and bone conduction, heating and cooling bursts, and flip sensing.

Utilizing the cell phone processor 410 in this manner may allow for a less expensive and more energy-efficient headset and harness system in one embodiment. The processor 410 can communicate with the headset over Bluetooth 415. It may also allow for easier integration of voice 420 and GPS 425 functions into the headset since the software and GPS sensing may be left to the cell phone. For example, the cell phone may download music and applications that control features, e.g., through voice commands, making the harness and headset operate as a Bluetooth headset rather than its own hardware .MP3 player. The headset still powers and drives the speakers and bone conductors, but need not have an advanced CPU and large storage capacity on board to do so.

In one example, when the earbud is disengaged the processor 410 stops sending sound information to the ear bud, but may increase the frequency spectrum of sound information sent to the bone conduction elements. For example, when the ear bud is engaged, the bone conduction elements may only receive audio information that is below 1000 Hz in one embodiment. In another embodiment, the audio information is kept below 600 Hz. But when the ear bud is disengaged, the bone conduction elements may receive audio information up to 16000 Hz in one embodiment.

This not only can save power, but it can avoid distraction when the user disengages the ear bud by no longer sending audio to that ear bud.

The processor 410 may also monitor the user's body temperature. If the user's temperature is above a threshold normal body temperature and the battery has at least a threshold capacity (e.g., 50%), the processor may enable a cooling burst. The cooling burst may utilize the Peltier effect by transferring electricity from a first conductor nearer to the user's skin to a second conductor. This may cause the conductor closest to the user to cool, and the user's sweat may conductively transfer the heat away from the user based on the cool conductor.

In another embodiment, the cooling burst is activated when a user's heart rate is above a threshold level, such as 150. One of the earpieces may include a laser or other sensor that can detect blood flow. In one embodiment, the sensor is positioned behind or below the user's ear lobe to monitor the user's pulse.

The processor 410 may also perform a heat burst by performing the Peltier effect in reverse. If the outside temperature is below a threshold that may be set by a user in one embodiment, the user's body temperature is below a threshold, and battery capacity is above a threshold, the heat burst may be performed.

The processor 410 may also detect that the user is swimming via a sensor on the base member that detects water saturation. Upon detection, the processor may deactivate the heating and cooling bursts and enable flip detection via a ball tilt sensor. Each time the ball tilt sensor triggers, the processor may count a lap so long as the ball tilt sensor triggers are at least a few seconds apart. The processor then may send a message to the user regarding the lap count and swim timing.

The processor may also communicate with over devices via Bluetooth. For example, the user may receive phone calls that are routed to the headset in one embodiment. In another embodiment, the Bluetooth communication may allow the user to set various features of the headset through use of a cell phone or computer.

The processor may further utilize GPS to perform route guidance. For example, a user may upload a map and/or route to the headset from a computing device (e.g., phone) in one embodiment. This may allow the headset to store less than a full GPS map, but enough of a map to perform the desired run or other exercise. The processor may then relay voice commands to navigate and/or encourage the user.

In another embodiment, the processor may recognize voice commands. The user may speak near a microphone that is part of the headset or an input to the base member to perform various tasks, including instructing the headset to communicate to an external device such as a phone (e.g., to read texts to the user or to place a phone call). In another embodiment, the user may adjust aspects of audio through voice commands, such as raising and lowering volume, pausing, or skipping tracks.

Figure 5:
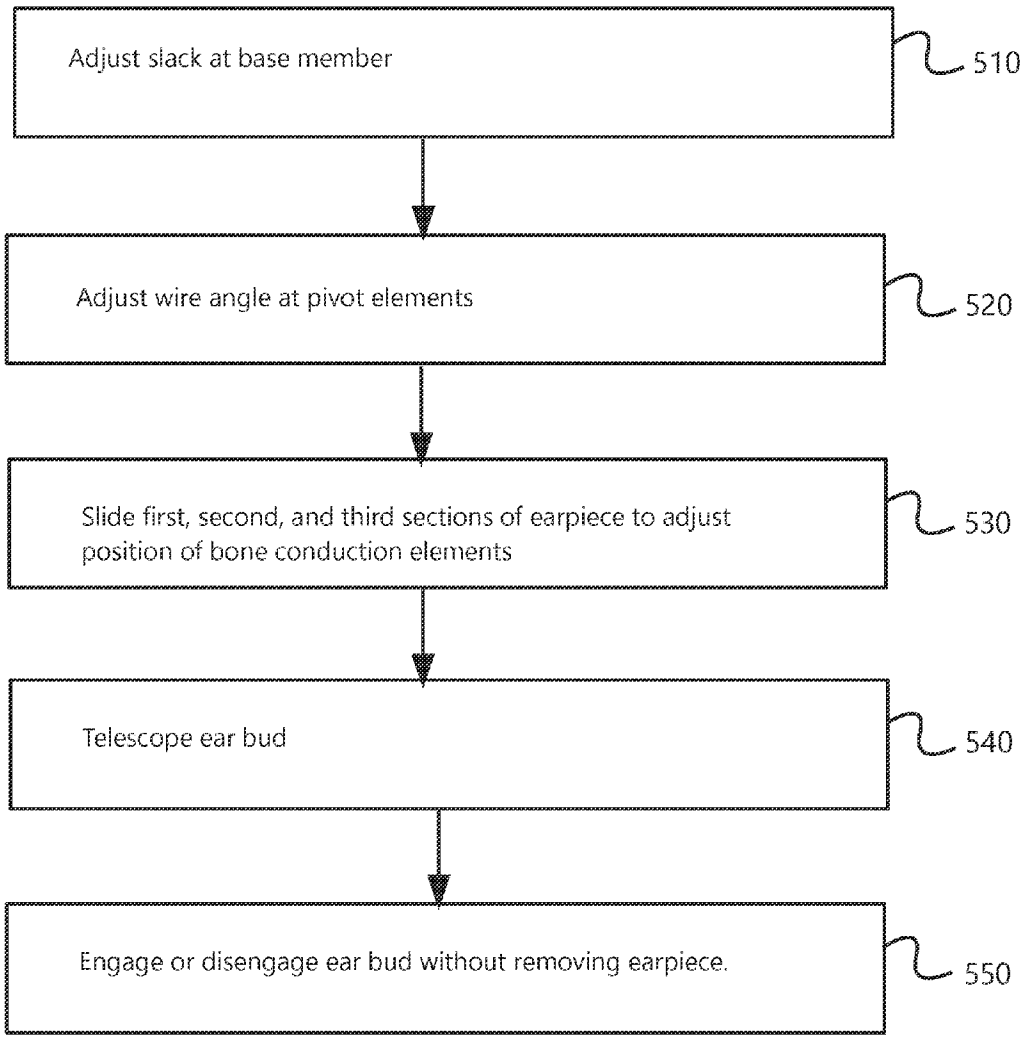
FIG. 5 is an exemplary flow chart, in accordance with an embodiment.

Turning to FIG. 5, exemplary method steps are presented for physically adapting a headset to the user, in accordance with an embodiment. At step 510, the headset may adjust slack at the base member. This may be an automatic adjustment caused by a spring-loaded reel in one embodiment. In another embodiment, this adjustment is done manually by turning a dial.

At step 520, the user may adjust the wire angle at pivot elements. The pivot elements may essentially hinge the wire at the user's neck region, allowing for a closer fit. In another embodiment, the earpiece(s) are wireless, foregoing the need for such adjustments.

At step 530, the user may adjust the location of bone conduction elements by sliding the first, second, and/or third sections of the earpiece. This may allow each user to ensure optimal bone conduction by placing the bone conduction elements directly on bone protrusions around the ear.

At step 540, the user may adjust the ear bud location by telescoping it in relation to the first section of the earpiece.

Along the same lines, at step 550, the user may engage or disengage the ear bud without removing the rest of the earpiece from their ear.

Figure 6:
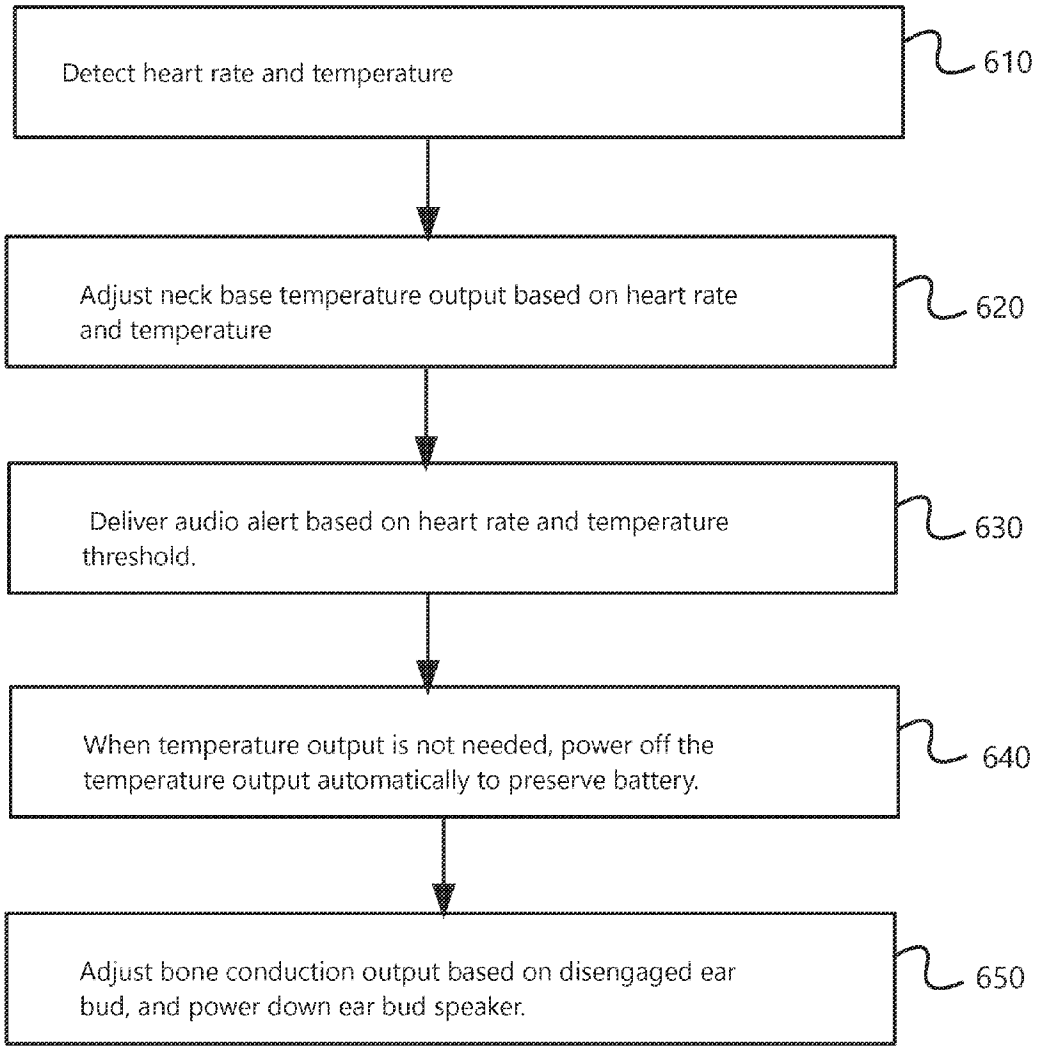
FIG. 6 is an exemplary flow chart, in accordance with an embodiment.

Turning to FIG. 6, exemplary method steps are presented for headset functionality, in accordance with an embodiment. At step 610, the headset may detect the user's heart rate and/or temperature. An earpiece may include a sensor for detecting blood flow, such as a laser that shines beneath the user's skin. In another embodiment, an external heart rate monitor may be plugged into the base member.

The base member or headset may also include a sensor that is against the user's skin and determines the user's body temperature. In one embodiment, the sensor also determines a reference ambient air temperature.

At step 620, the base member may provide a thermodynamic temperature burse based on the user's heart rate and temperature. For example, if the user's heart rate is above 150 and their body temperature is above a threshold, a cold burst may be supplied. In one embodiment, the cold burst is only supplied if the ambient air temperature is above a threshold, such as 75 degrees Fahrenheit.

At step 630, the headset may deliver an audio alert to the user based on the user's heart rate and a temperature threshold. In one embodiment, the headset may alert the user when their heart rate crosses a threshold, such as 160. In another embodiment, the user may target an ideal heart rate such as 150, and the headset may alert the user periodically if their heart rate is too high or low.

At step 640, the headset may determine that cooling or heating is not needed and power of the temperature output to preserve battery life. This may also occur when the battery power drops below a threshold in one embodiment.

At step 650, the headset may detect that an ear bud is disengaged, and stop powering that ear bud to save battery life. It may also, in one embodiment, adjust output to the bone conduction element to provide a wider frequency response.

FIG. 7 is an exemplary illustration of a solar harness 710 on the back of a user 720, in accordance with an embodiment. The harness may have solar panels 738 located on it that are exposed to sunlight on the back of the user 720. The harness 710 can include an adjustment strap 740 to pull the harness 710 tighter around the user's 720 lower torso. An additional adjustment member 750 can additionally tighten the harness 710 around the user's 720 upper torso. The adjustment member 750 can also include circuitry for managing charge on the solar panels 738, including a battery for storing some amount of the charge and USB ports for connecting items for charging. In this example, the base member 120 is connected via USB to the solar harness, allowing it to charge while in use.

Haptic feedback elements 780 may be embedded into the shoulder straps of the harness 710. The haptic feedback elements 780 may be used to convey information to the user without interrupting audio in the headset in an embodiment. For example, multiple vibrations may indicate that a device has been disconnected from the solar harness. The cell phone may control haptic vibrations to indicate things like mile markers in a run. Other uses of the haptic feedback elements 780 are also possible.

FIG. 8 is an exemplary illustration of the solar harness 710 on the front of a user 820, in accordance with an embodiment. The front of the solar harness 710 may include additional solar panels 838. In addition, a water-proof and/or sealable pocket 860 may be included for housing a cell phone. The user may place their phone inside the pocket 860, which may include a charging port, and seal the pocket so that the phone is protected from water. This may allow the user to swim or run in the rain while still using the cell phone for music and to otherwise act as the brain for the headset. A three-way buckle mechanism 870 can allow the user to fasten or remove the harness 710 from their body 820.

Figure 9:
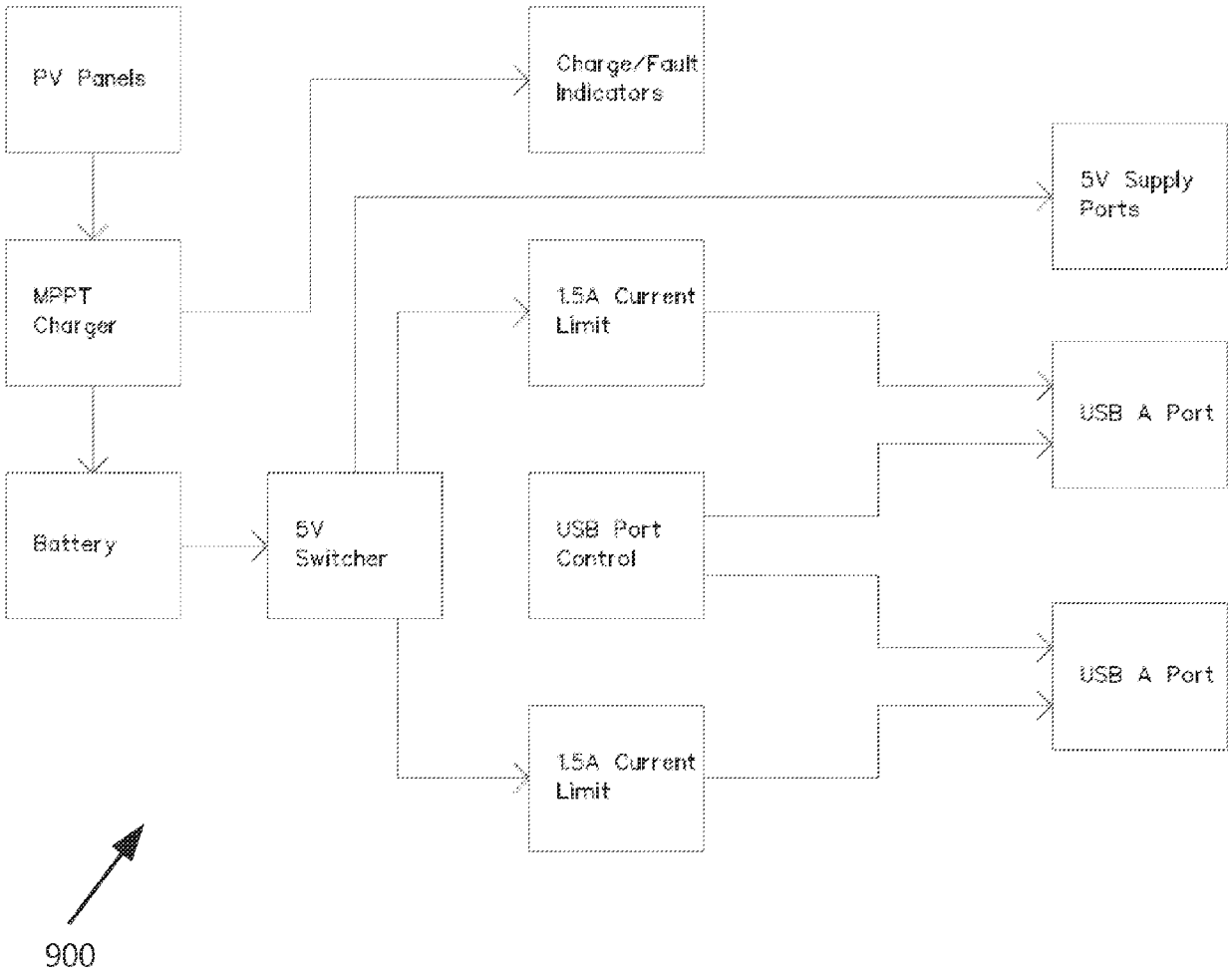
FIG. 9 is an exemplary diagram of system components, in accordance with an embodiment.

FIG. 9 is an exemplary diagram of solar harness circuitry 900, in accordance with an embodiment. The solar harness may include PV panels that feed into a charger. The charger may charge a battery, such as an on-board battery that may be used to further charge batteries of periphery devices such as the cell phone or headset. The on-board battery may be connected to a switcher with current limiters that deliver the current to a plurality of USB ports.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A wearable headset apparatus, including:

a first earpiece including:

a first ear bud that is detachably directly coupled to a first section, the first earbud including a speaker;

a first bone conduction element coupled to a second section, wherein the first section is slidably coupled to the second section such that the first and second sections form an arc for positioning behind the ear and by sliding at least one of the first and second sections to cause the bone conduction element may be repositioned along the arc, and a base member that delivers audio information to the first earpiece.

2. The wearable headset apparatus of claim 1, wherein detachable coupling of the first ear bud allows the ear but to be detached and hang from the first section substantially without disturbing positioning of the first bone conduction element.

3. The wearable headset apparatus of claim 1, further including a first pivoting element between the first earpiece and the base member.

4. The wearable headset apparatus of claim 3, wherein the base member retracts at least a portion of connective wire coupled to the first pivoting element into the base member.

5. The wearable headset apparatus of claim 1, wherein the base member magnetically attaches to a solar harness that charges a battery in the base member.

6. The wearable headset apparatus of claim 5, wherein base member is coupled to a cooling mesh that hangs from the base member to make contact with the back of a user, the cooling mesh being comprised of copper wire enclosed in a water-wicking polyester.

7. The wearable headset apparatus of claim 1, further including a second earpiece connected to the base member.

8. The wearable headset apparatus of claim 7, wherein the second earpiece includes a microphone component.

9. The wearable headset apparatus of claim 8, wherein microphone component is a vocal conducting microphone that is applied to a user's throat.

10. The wearable headset apparatus of claim 7, wherein the base member includes a crank that allows a user to manually retract wires that deliver the audio information to the first and second earpieces.

11. The wearable headset apparatus of claim 1, further including a ball tilt sensor that the processor uses to count each time the headset flips, causing the processor to increment a lap counter.

12. The wearable headset apparatus of claim 11, wherein the processor delivers audio information signifying a lap number in response to incrementing the lap counter.

13. The wearable headset apparatus of claim 1, wherein the second section further includes a heart rate sensor that measures a user's pulse from behind the user's ear.

14. The wearable headset apparatus of claim 1, wherein the base member communicates with a cell phone, the cell phone providing the audio information to the base member.

15. The wearable headset apparatus of claim 1, wherein the first ear bud includes a conforming foam piece with a tube spanning through the foam piece from a sealed proximate end to an open distal end of the foam piece, wherein a speaker is positioned at the sealed proximate end.

16. The wearable headset apparatus of claim 1, wherein the first ear bud includes a a rubber ring that protrudes around an outer circumference of the first ear bud, wherein the rubber ring conforms to the inside of a user's ear.

17. The wearable headset apparatus of claim 1, wherein the first ear bud includes a a rubber ring that protrudes around an outer circumference of the first ear bud, wherein the rubber ring conforms to the inside of a user's ear.

18. The wearable headset apparatus of claim 1, wherein the base member includes a battery that is recharged by a solar panel port and by converting mechanical movement.

19. The wearable headset apparatus of claim 1, wherein the base member limits frequencies above 1000 Hz sent to the first bone conducting element, and limits frequencies below 1000 Hz sent to the first ear bud.

20. The wearable headset apparatus of claim 1, wherein the first earpiece includes a second bone conduction element on a third section that is slidably coupled to the second section.

* * * * *